United States Patent [19]

Halleck

[11] Patent Number: 4,729,057

[45] Date of Patent: Mar. 1, 1988

[54] STATIC CHARGE CONTROL DEVICE WITH ELECTROSTATIC FOCUSING ARRANGEMENT

[75] Inventor: Michael E. Halleck, Longmont, Colo.

[73] Assignee: Westward Electronics, Inc., Aurora, Colo.

[21] Appl. No.: 884,011

[22] Filed: Jul. 10, 1986

[51] Int. Cl.[4] ..... H05F 3/06

[52] U.S. Cl. ..... 361/213; 361/235

[58] Field of Search ..... 361/212, 213, 229–232, 361/235

[56] References Cited

U.S. PATENT DOCUMENTS

| | | | |
|---|---|---|---|
| 3,308,343 | 3/1967 | Smith et al. | 361/235 |
| 3,308,344 | 3/1967 | Smith et al. | 361/235 |
| 3,317,790 | 5/1967 | Whitby | 361/229 |
| 3,624,448 | 11/1971 | Saurenman | 361/225 |
| 3,643,128 | 9/1971 | Testone | 361/229 |
| 3,711,743 | 1/1973 | Bolasny | 361/231 |
| 3,936,698 | 8/1973 | Meyer | 361/235 |
| 3,976,916 | 8/1976 | Saurenman | 361/229 |
| 4,038,583 | 7/1977 | Breton | 361/230 |
| 4,048,667 | 4/1977 | Brennecke | 361/213 |
| 4,092,543 | 5/1978 | Levy | 361/213 |
| 4,151,577 | 4/1979 | Yavnieli et al. | 361/231 |
| 4,188,530 | 11/1979 | Miller | 361/213 |
| 4,216,518 | 8/1980 | Simons | 361/213 |
| 4,333,123 | 6/1982 | Moulden | 361/213 |
| 4,388,667 | 6/1983 | Saurenman | 361/231 |
| 4,477,263 | 10/1984 | Shaver et al. | 361/231 |
| 4,484,249 | 11/1984 | Saurenman | 361/231 |
| 4,498,116 | 2/1985 | Saurenman | 361/213 |
| 4,502,091 | 2/1985 | Saurenman | 361/213 |
| 4,502,093 | 2/1985 | Saurenman | 361/232 X |
| 4,528,612 | 7/1985 | Spengler | 361/213 |
| 4,542,434 | 9/1985 | Gehlke et al. | 361/235 X |
| 4,630,167 | 12/1986 | Huggins | 361/235 X |

*Primary Examiner*—L. T. Hix
*Assistant Examiner*—D. Rutledge
*Attorney, Agent, or Firm*—Robert E. Harris

[57] ABSTRACT

A static charge control device is disclosed having an electrostatic focusing arrangement. The device requires no forced air element yet enables ions, produced at separate positive and negative needle electrodes, to be separately directed outwardly to a neutralizing area for neutralization of static charges thereat. The needle electrodes are mounted on a mounting plate so that the tips of the needles extend forwardly through different apertures in the forwardly positioned electrostatic focusing plate. Positive and negative ions, produced at the needle electrodes by continuous DC voltages applied to the needle electrodes, are moved forwardly from the needle electrodes toward a neutralizing area due to repulsion forces, and are focused by the electrostatic focusing plate to establish a substantially uniformly diverging pattern, the axis of which is normal to the electrostatic focusing plate when the needle electrodes are centrally positioned within the apertures in the electrostatic focusing plate, and forms an acute angle with the electrostatic focusing plate when the needle electrodes are offset with respect to the centers of the apertures.

19 Claims, 5 Drawing Figures

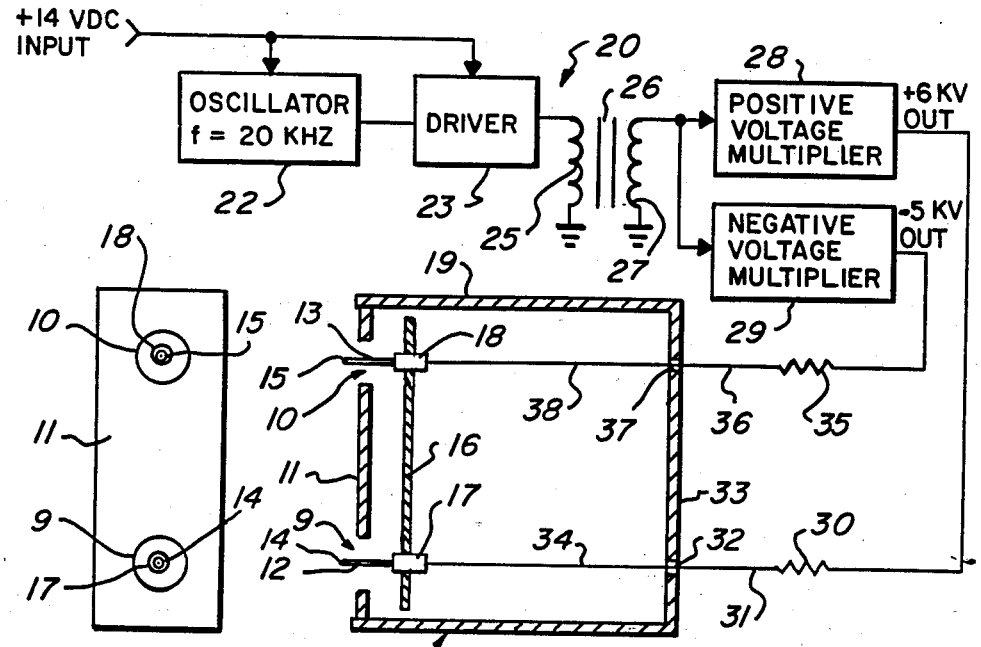
Fig_2
Fig_1
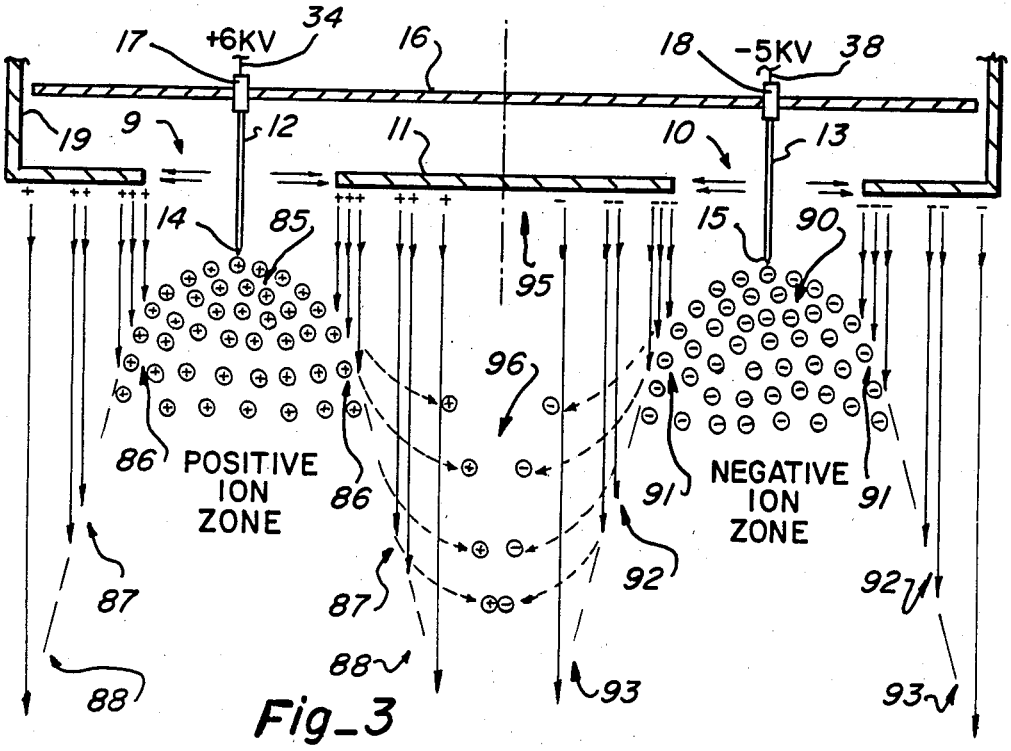
Fig_3

STATIC CHARGE CONTROL DEVICE WITH ELECTROSTATIC FOCUSING ARRANGEMENT

FIELD OF THE INVENTION

This invention relates to a static charge control device, and, more particularly, relates to a static charge control device having an electrostatic focusing arrangement.

BACKGROUND OF THE INVENTION

Electronic technology, with its associated solid state components, has evolved into the miniaturization of sensitive large scale integrated circuits used to develop sophisticated and low power electronic products for both consumer and industry. At least some of the devices, including particularly CMOS and MOSFET devices, are sensitive to damage and degradation from localized static charges, that can occur, for example, during packaging, assembly, and field installation. By way of specific example, it has been found that walking across a carpeted area can generate enough static voltage to destroy some CMOS devices, and statically charged, non-conductive plastics can present a field hazard when the charge is as little as 500 volts.

Static charge elimination, or at least reduction, during manufacture of sensitive systems, has been the target of considerable research as well as product development. Also, in the past few years, many papers have been written on the subject of electrical overstress and electrostatic discharge, and various symposiums and technical papers have been directed thereto.

Numerous active and passive types of equipment, ranging from complete room ionization systems to bench top products, have heretofore been suggested and/or utilized in an attempt to control static discharge. The active products essentially use the same general principle for minimizing or eliminating static charges, but utilize different techniques.

The application of the general principle normally utilized to control static charges consists of a means of generating equal and sufficient amounts of positive and negative air ions, and then propelling them into a neutralizing, or work, area in order to discharge any charged materials thereat.

Radioactive materials have heretofore been used for ion production with such radioactive materials producing alpha particles with sufficient energy to collide with neutral air molecules and dislodge electrons from their outer orbits. This can produce a nitrogen or oxygen molecule with one less electron than normal thereby creating a positive ion. The dislodged electron with a charge of about $1.6\times10^{-19}$ coulombs attaches itself to another neutral molecule and becomes a negative air ion. The isotope used to generate these ions have a short half life and must be replaced every six months to one year.

The radioactive system to generate ions requires a fan or blower since the ions will travel only between two and four inches from the radioactive source. The fan blows a turbulent flow of air through the positive and negative ions and propels them into the work area. The effective working distance of this system is related to how far the ions can be propelled before recombination occurs. Therefore, the larger the fan, the more cubic feet of air, and the faster and therefore farther the ions are propelled.

A second arrangement heretofore utilized to produce ions utilizes electrical means whereby a high voltage AC power supply is attached to a sharp needle point which intensifies the field surrounding the needle. The same mechanisms that produce the ions using a DC power supply, as brought out hereafter, apply to the AC power supply system. However, since the AC system voltage changes polarity to about 60 HZ intervals, both positive and negative ions can be produced from a single needle source.

The AC system to generate ions also requires a fan or a blower to propel the produced ions toward the work area since the 60 HZ line frequency used to generate the ions propels the electrons from the sharp needle point on the negative half of the cycle, and removes electrons from the surrounding air on the positive half of the cycle. This will result in ion generation that will be transported only about two to four inches from the needle source depending on the amplitude of the voltage. The fan blows a turbulent flow of air across a series of sharp needles and propels the ions into the work area. The effective working distance of this system is the same as described for the radioactive system. However, a long series of needles spaced at an appropriate distance can be suspended from the ceiling of a room, and gravity used to fill an entire room with oppositely charged ions.

A third arrangement (which is the type arrangement used in this invention) heretofore utilized to produce ions utilizes electrical means whereby a DC high voltage power supply is attached to a sharp needle point which intensifies the field surround the needle. The dielectric strength of air is overcome, corona discharge occurs, and current flows either into the needle point from the air for positive ions, or from the needle point into the air for negative ion generation. The field strength needed depends upon temperature and pressure and is generally between 20,000 and 30,000 volts per centimeter. Since it is generally easier to produce negative ions than positive ions, the positive power supply is usually adjusted to a higher DC potential than the negative supply to create the same number of ions.

The DC voltage system to generate ions requires at least two sharp needle points spaced at an appropriate distance with opposite polarity power supplies (generally under 10,000 volts each) in order not to exceed OSHA ozone limits of 0.1 ppm. The DC voltages utilized have also been pulsed either into the two needle points, or a single point may be used if the positive and negative voltages are alternately switched into the single point.

The DC voltage system of ion generation has used several methods to propel the ions into the work area. Since two independent needles are used, one to produce positive ions and the other to produce negative ions, electric fields of opposite polarities are generated at the needle points.

At the negative needle point, a constant source of electrons from the needle point are propelled into the air in front of the needle. Since like charges repel each other, the electrons are propelled by repulsion into the air, as are the negative air ions generated by corona discharge in the vicinity of the needle point.

At the positive needle point, electrons are pulled out of the surrounding air and positive ions are generated by corona discharge in the vicinity of the needle point. Again, the like charges repel each other and the positive ions are propelled by repulsion into the air.

If the discharge or needle points are closer spaced than about three to four feet, ion current will also flow between these electrodes. The magnitude will be related to the square of the distance between the electrodes. Also in the area, the positive ions will be attracted to the negative ions and recombination will occur.

The foregoing results in a constant source of positive and negative ions propelled thru the air by ion repulsion without the aid of a fan or blower. If the DC voltages at the needle electrodes are pulsed, the ions can be propelled even further distances than with bipolar constant DC. The increased propulsion distance will be related to the pulse time and is typically about two to four seconds. However, as the pulse frequency decreases, spurts of alternate polarity ions can charge up isolated conductors or non-conductors to several thousand volts for this two to four second period of time in close proximity to the pulsed DC equipment. This can be dangerous to sensitive electronic equipment.

A fan or blower has also been used to propel the ions generated by DC techniques even further into the work field. Again, the fan has been heretofore used to blow a turbulent flow of air across closely spaced electrodes of opposite polarity, either constant DC or pulsed DC. With pulses DC systems the pulse time is usually decreased from a time of two to four seconds to $\frac{1}{4}$ to $\frac{1}{2}$ second in order to reduce the spurts of alternate polarity ion charge concentrations that may be dangerous to sensitive electronic equipment. Thus, bipolar constant DC or pulsed DC systems can be used as total room air ionization systems without the use of a fan by suspending the needle emitters with appropriate spacings at the ceiling.

Static charge control devices having both positive and negative needle electrodes for producing ions are shown, for example, in U.S. patents issued to Moulden (U.S. Pat. Nos. 4,319,302 and 4,333,123, for example), and in U.S. patents issued to Saurenman (U.S. Pat. No. 3,624,448, for example), with the needle electrodes being pulsed by means of a voltage generator coupled to the needle electrodes. In the device shown in the referenced Moulden patents, the needle electrodes are positioned within plastic tubes, and in the device shown in the referenced Saurenman patent, the needle electrodes are positioned within shaped recesses.

Utilization of forced air units, such as a fan, to propel ions away from an area where ions have been produced, is also shown, for example, in U.S. Pat. Nos. 4,319,302, 4,333,123 and 3,624,448. Not all systems heretofore suggested, however, have required forced air units, and a system that does not utilize forced air is shown, for example, in U.S. Pat. No. 4,038,383 (Breton).

Balancing of ions directed to a work area has also been heretofore suggested, with balancing by adjusting the positioning of the needle electrodes being shown in U.S. Pat. No. 4,092,543 (Levy), for example, which patent also suggests that the prior art teaches such balancing by adjustment of the DC voltages supplied to the needle electrodes.

As can be appreciated from the foregoing, while various devices have heretofore been suggested for controlling static charges, improvements in such devices, including improvements in directing ions away from the ion producing area, in providing of voltages to the electrodes, and/or in positioning of the elements of the system, can still be utilized.

SUMMARY OF THE INVENTION

This invention provides an improved static charge control device having an improved arrangement for directing and/or carrying ions away from the ion producing area, having an improved voltage supply arrangement for producing ions at the electrodes, and/or an improved positioning arrangement of the electrodes relative to the other elements of the overall system to thereby effect more efficient static charge control.

More particularly, this invention is directed to an improved static charge control device that provides improved positioning of the electrodes producing the ions relative to an electrostatic focusing element which directs the ions away from the needle electrodes, with movement of the ions away from the electrodes not requiring use of a forced air unit.

It is therefore an object of this invention to provide an improved static charge control device.

It is another object of this invention to provide an improved static charge control device that includes positive and negative electrodes for separately providing positive and negative ions, which ions are efficiently conveyed to a neutralizing area.

It is still another object of this invention to provide an improved static charge control device having an improved voltage generating system for separately providing positive and negative voltages to the needle electrodes utilized for producing positive and negative ions.

It is still another object of this invention to provide an improved static charge control device having an improved arrangement of electrodes and apertures for producing ions and carrying produced ions to a neutralizing area.

It is still another object of this invention to provide an improved static charge control device having an electrostatic focusing arrangement.

It is yet another object of this invention to provide an improved static charge control device that required no forced air unit for carrying ions from the ion producing area to a neutralizing area.

It is yet another object of this invention to provide an improved static charge control device having an electrostatic focusing arrangement mounted adjacent to a mounting element having needle electrodes mounted thereon so that the needle electrodes extend through the apertures in the electrostatic focusing element in order to achieve the desired end.

With these and other objects in view, which will become apparent to one skilled in the art as the description proceeds, this invention resides in the novel construction, combination, and arrangement of parts substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which:

FIG. 1 is a schematic diagram of the electrostatic charge control device of this invention;

FIG. 2 is an end view of the housing shown in FIG. 1 and illustrating positioning of the electrodes within the apertures of the electrostatic focusing plate;

FIG. 3 is a partial top view of the housing shown in FIGS. 1 and 2 and illustrating ion formation at the needle electrodes as well as focusing of the ions by the electrostatic focusing plate as the ions move outwardly from the needle electrodes with the flow shown being in a substantially uniformly diverging pattern the axis of which is normal to the electrostatic focusing plate;

DESCRIPTION OF THE INVENTION

Figure 4:
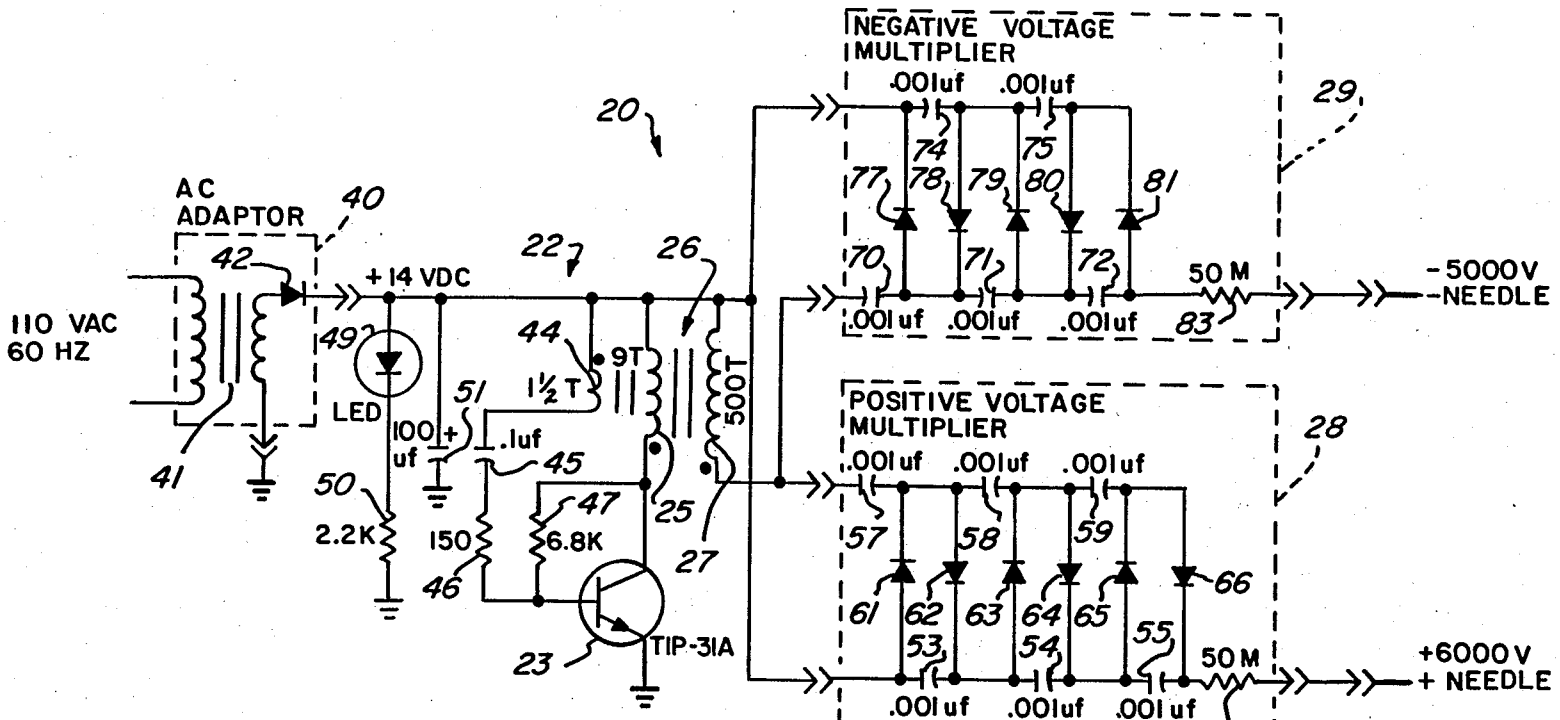
FIG. 4 is an electronic schematic diagram of the voltage generating unit shown in block form in FIG. 1.

As brought out above, an electrostatic charge control device normally emits an equal number of positive and negative ions toward a neutralizing, or work, area to neutralize static charges thereat. Although an equal number of positive and negative ions in the air will result in an overall net charge of zero, such charges of opposite polarity can nevertheless coexist in an air environment since there are about $3\times10^{19}$ neutral air molecules for every ion in such an environment and the neutral air molecules also tend to isolate the charged air molecules.

Oppositely charged ions neutralize each other when they meet, however, and therefore a constant source of such ions must be made available for continuous static charge neutralization at a work area. This recombination process is also responsible for neutralizing static charges on isolated surfaces of non-conductive and conductive material.

An ion-ion recombination system actually represents a loss mechanism whereby the negative ions, and/or electrons, recombine with the positive ions. The loss rate factor is directly proportional to the concentration of positive ions (N+) and negative ions (n−) and, since a balanced condition should exist, then:

$$\frac{d}{dt}N+ = \frac{d}{dt}N- \text{ or Loss} = (-KN+ \times N-)$$

where K=recombination coefficient. If the number of positive ions (N+) is equal to the number of negative ions (N−), which occurs in almost all discharges, then Loss$=-KN^2$, where N is equal to the total number of positive and negative ions. If the $$\text{Loss} = \frac{dn}{dt}, \text{ then } \frac{dn}{dt} = -KN^2.$$

$$\text{Integrating } \frac{dn}{dt} = -KN^2 \text{ yields } \frac{1}{N} = \frac{1}{N_O} + Kt$$

where K=recombination coefficient, t=time in seconds, and $N_O$ is the initial concentration at t=0. Therefore there exists a linear ion concentration with time.

The Thompson theory of recombination for low pressure systems suggests a 3-body mechanism. It assumes that two ions of opposite signs do not combine unless they are closer than a critical distance r. If the ions are within the critical distance, they will recombine only if there is a third gas molecule to carry off the energy released in the recombination process, that is, a 3-body collision process. The recombining ion has a potential energy equal to the average energy of thermal agitation.

In addition, a two body recombination system may also occur. In this case, the ions do not combine, but neutralize each other through the transfer of an electron from the negative to the positive ion. The energy liberated in this process results in electron excitation and imparts kinetic energy to the two resulting atoms, and may be independent of pressure.

A second system of radiative recombination may occur between an electron and positive ion, and its mechanism is different than that of the ion-ion recombination. A free electron is captured by an ion and accompanied by the emission of a photon.

Electron attachment represents a third system of recombination. This mechanism is common for gases whose outer electron shells are nearly filled whereby an electron attaches itself to a neutral atom or molecule. The electron affinity or energy of information of a negative ion doesn't occur with atoms having closed electron shells such as the noble gases, with the exception of hydrogen.

Neutral atoms and molecules represent a fourth system of recombination. An electron having a kinetic energy, $E_1$, may collide with a neutral gas molecule, XY, thereby supplying energy to produce a positive and negative ion with another resulting kinetic energy, $E_2$. Therefore, $E_2$=[$E_1$+electron affinity−ionization energy of atom X−dissociation energy of X and Y] into the neutral atoms X and Y. The energy of the electron must be greater than a certain threshold level for this reaction to occur (as an example, for oxygen the electron energy is approximately 21 volts).

The ionizing potential or the voltage E through which the electron must fall in order to have enough energy to dislodge an electron from a molecule is directly related to the energy required and inversely related to the charge of an electron ($1.6\times10^{-19}$ coulomb) which can be expressed as:

$$KE = Ve \text{ or } V = KE/e.$$

An average small gas molecule such as nitrogen or oxygen will have a diameter of about $2.5\times10^{-10}$ meters. Forces between molecules practically cease at a distance between molecules of about $10^{-9}$ meters or approximately the distance equivalent to 4 diameters.

If the air molecules were treated as an ideal gas at standard conditions, then the root-mean-square, or typical molecular speed of the molecule, follows the following relationship:

$$V_{rms} = \frac{(3P)^{\frac{1}{2}}}{\rho}\left(\frac{3\times1.013\ 10^5}{1.293}\right) = 485 \text{ m/sec} = 942 \text{ mph}$$

where

P=pressure of air (Newton/m$^2$)=$1.013\times10^5$ at 1 atmosphere, and

P=density of air (Kg/m$^3$)=1.293 at 0° C. at 1 atmosphere.

Note that the kinetic energy per molecule of any gas is nearly the same.

$$KE = \frac{MV^2}{2} = \frac{1}{2} \times .0288 \times 485^2 = 3387 \text{ joules/mole,}$$

where

KE=energy in joules/mole,

M=molecular weight air=28.8 grams=0.0288 kg, and

V=velocity of molecule=485 m/sec.

The number of collisions that will occur between molecules follows the following relationship:

$$C = \pi d^2 n \sqrt{2}\ V =$$

$$\pi \times (2.5 \times 10^{-8})^2 \times 3. \times 10^{19} \times 1.4 \times 48500 \cong 4 \times 10^9$$

where d=Avg diameter of molecule=$2.5\times10^{-10}$ m=$2.5\times10^{-8}$ cm, n=no. atoms per $cm^3$ in air=$3.0\times10^{19}$, and v=rms speed of molecule=485 m/sec=48500 cm/sec Therefore, $4\times10^9$=about 4 billion molecules will collide every second.

The mean free path between molecules at standard conditions before collision occurs will follow the following relationship:

$$\rho = \frac{1}{\pi \sqrt{2}\ C d^2} =$$

$$\frac{1}{\pi \times 1.4 \times 4.9 \times 109 \times (2.5 \times 10^{-8})^2} = 7.5 \times 10^{-6} \text{ cm}$$

where v=rms speed of molecule=48500 cm/sec,

C=no. of collisions per second=$4\times10^9$/sec, and d=average diameter of molecule=$2.5\times10^{-8}$ cm.

Therefore, the average distance that the molecule can travel before it hits another molecule$\cong7.5\times10^{-6}/2.5\times10^{-8}$=300 diameters of an average molecule.

An improved static charge control for freeing the work surface from localized static charges during packaging, assembling and feed installation of sensitive electronic equipment and products is provided by this invention using a non-fan ionizer.

The device of this invention can be used in virtually all applications to replace blower systems and can be used in most applications where blowers are inappropriate, as, for example, where the air velocity near the blower hinders operation by cooling solder joints, blowing paperwork and light objects, and agitating dust and particulate matter.

As indicated in FIG. 1, housing 7 can be a closed chamber except for spaced apertures 9 and 10 in front wall 11. Front wall 11 forms an electrostatic focusing, or lens, plate, and, as illustrated in FIG. 2, apertures 9 and 10 formed therein may be of circular shape (these apertures could, however, be square, rectangular, or parabolic in shape, if desired, for concentrating ion focus).

As also indicated in FIGS. 1 through 3, needle electrodes 12 and 13 having tips 14 and 15, respectively, are mounted on mounting plate 16 by conventional mounting brackets 17 and 18, respectively, so that the electrodes extend normally from the plate with tips 14 and 15 of the electrodes constituting the forward free ends of the electrodes. Mounting plate 16 is positioned within housing 7 at the front portion thereof (plate 16 may be fastened to side walls 19 in any conventional fashion) so that plate 16 is parallel to electrostatic focusing plate 11).

As shown in FIG. 1, electrodes 12 and 13 extend through apertures 9 and 10 in electrostatic focusing plate 11 and, as indicated in FIG. 1, the electrodes are preferably centrally positioned within the associated aperture with tips 14 and 15 of the electrodes extending forwardly beyond wall 11 for achieving ion flow as indicated in FIG. 3.

As also indicated in FIG. 1, a voltage generating unit 20 is provided to supply a continuous DC voltage of positive polarity and a continuous DC voltage of negative polarity to needles 12 and 13, respectively. Voltage generating unit 20, as indicated in FIG. 1, includes an oscillator 22 (20 KHz) connected with driver 23, both of which receive a +14 DC voltage (which may be conventionally supplied from a battery or a step-down transformer connected with a conventional 110 volt power supply).

Driver 23 is connected with primary winding 25 of step-up transformer 26, the secondary winding 27 of which provides an AC signal having an amplitude of about 1,000 volts peak-to-peak to positive voltage multiplier 28 and negative voltage multiplier 29. As also indicated in FIG. 1, positive voltage multiplier 28 is connected with positive needle electrode 12 through resistor 30, lead 31, connector 32 (in rear wall 33 of housing 7), and lead 34 to supply a constant +6 KV DC output to electrode 12.

During the positive half of the 20 KHz input signal, the output of the positive voltage multiplier 28 charges up to about °6 KV, and supplies constant voltage to needle electrode 12, which current is limited for safety reasons by resistor 30, to about 100 μa.

Negative voltage multiplier 29 is connected with negative needle electrode 13 through resistor 35, lead 36, connector 37 (in rear wall 33 of housing 7), and lead 38 to supply a constant −5 KV DC output to electrode 13.

During the negative half of the 20 KHz input signal, the output of negative voltage multiplier 29 charges up to about −5 KV, and supplies constant voltage to needle electrode 13, which current at the needle electrode is limited for safety reasons by resistor 35 to about 100 μa.

Housing 7 (including side walls 19, rear wall 33, and electrostatic plate (front wall) 11) and mounting (or support) plate 16 are preferably made of electrically non-conductive material. In a working embodiment of this invention, electrodes 12 and 13 were spaced about 2.25 inches apart, apertures 9 and 10 were about $\frac{3}{8}$ inches in diameter, the electrostatic plate 11 was about 1.0 inches by $4\frac{1}{2}$ inches.

Since a balanced number of positive air ions and negative air ions are needed to provide effective static discharge of isolated conductive and non-conductive materials in the work field of interest, and since it is easier to generate negative air ions than positive air ions, voltage generating unit 20 provides different constant DC voltages to electrode needles 12 and 13.

Voltage generating unit 20 is shown in greater detail in FIG. 4. As shown, +14 volt DC is supplied by AC adapter 40 (having transformer 41 connected with a conventional 110 volt AC power source and diode 42)

to oscillator 22 and driver 23. As shown, the +14 VDC is coupled to the base of transistor 23 through winding 44 (1½ turns) of transformer 26 and series connected capacitor 45 and resistor 46. In addition, the +14 VDC is connected to the collector of transistor 23 through primary winding 25 (9 turns) and the base and collector of transistor 23 are connected through resistor 47. As also shown in FIG. 4, the +14 VDC power is also supplied to one side of LED 49, the other side of which is connected with ground through resistor 50. In addition, a capacitor 51 is connected between the +14 VDC power and ground.

Secondary winding 27 of transformer 26 is connected to positive and negative voltage multipliers 28 and 29. As shown in FIG. 4, positive voltage multiplier 28 includes a first group of series connected capacitors 53, 54 and 55 connected to one side of winding 27, and a second group of series connected capacitors 57, 58 and 59 connected to the other side of winding 27. Parallel connected diodes 61, 62, 63, 64, 65 and 66 are connected between different ones of the capacitors of each group, and a high voltage output (+6,000 volts) is coupled from multiplier 28 through resistor 68.

In like manner, negative voltage multiplier 29 includes a first group of series connected capacitors 70, 71 and 72 connected to one side of winding 27, and a second group of series connected capacitors 74 and 75 connected to the other side of secondary winding 27. Parallel connected diodes 77, 78, 79, 80 and 81 are connected between different ones of the capacitors of each group, and a high voltage output (−5,000 volts) is coupled from multiplier 20 through resistor 83.

It has been found that a voltage difference of about 1,000 volts, with the positive being the greater voltage, is required to produce a nearly balanced number of positive and negative ions at needle electrodes 12 and 13. Any difference in ion balance results in isolated charged or uncharged conductive or non-conductive materials, in the work field in front of the device, to acquire a static charge in volts that is directly related to the positive and negative ion imbalance condition. This charge is designed to be less than 100 volts for isolated materials in excess of twelve inches from front plate 11.

Due to the mechanical design of the electrostatic lens, or focusing, assembly 11, and its proximity to needle electrodes 12 and 13, the voltage imbalance can be reduced to near zero volts on isolated charged or uncharged conductive or non-conductive materials, in the work field in front of the device, by adjusting the relative lengths of the needle electrodes. If the voltage imbalance is positive, then the positive electrode needle is made shorter, and vice versa.

As described above, the positive and negative air ions used to discharge isolated static charges on conductive or non-conductive materials requires high DC voltage supplied to a sharp needle point that intensifies the field surrounding the needle. The dielectric strength of the air is overcome, corona discharge occurs, and current flows either into the needle point from the air for positive ions, or from the needle point into the air for negative ion generation. As indicated in FIG. 3, this provides ions at needle 12 and negative ions at needle 13.

Electrostatic lens 11 (formed of non-conductive material) is mounted so that the apparatus therein surround needle electrodes 12 and 13, and the field generated on the lens focuses and helps to propel the positive and negative air ions into the work area, or neutralizing area of interest, at distances up to four or five feet, in front of the device without the use of a forced air unit such as a fan. The distance the ions are propelled is directly related to the concentration of ions generated (and therefore to the voltage provided by the power supply), the sharpness of the tips of the needle electrodes, and the shape and area of the apertures in the electrostatic lens.

Using a circular opening for the lens, as indicated in FIG. 2, a field and charge is produced that extends 360 degrees around needle electrodes 12 and 13. With positive needle electrode 12 centered in circular opening 9, and with the +6 KV supplied to needle electrode 12, a field perpendicular to needle electrode 12 is generated the entire length of the needle electrode, and this causes a static positive charge to form around the circumference of circular opening 9. This charge decreases in intensity as the distance from the center of needle electrode 12 increases both to the left and right, as indicated in FIG. 3. Of course, this charge actually is formed 360 degrees around needle electrode 12.

As indicated in FIG. 3, the corona discharge at the sharp point of the needle electrode 12 creates positive air ions, mostly from nitrogen, and these ions fill area 85 immediately in front of needle electrode 12.

The positive electrostatic charge formed at the walls defining aperture 9 creates a field perpendicular to its surface and influences the positive ions at area 85. Since like charges repel each other, a large repulsion force (at area 86) propels the air ions forwardly and away from electrostatic lens 11. The field further from electrostatic lens 11 (shown at area 87) has reduced intensity and this allows the ions to diverge into a larger area. This also applies to the field still further from electrostatic lens 11 (shown at area 88). While shown as being grouped, in reality the charges are formed uniformly from a greater to a lesser charge.

With negative needle electrode 13 centered in circular opening 10 of electrostatic lens system 11, and with the −5 KV supplied to needle electrode 13, and with a field perpendicular to needle electrode 13 is generated the entire length of the needle electrode, and this causes a static negative charge to form around the circumference of circular opening 10 and influences the negative ions at area 90. Operation is the same as described above for the positive ions, except that the negative ions are now influenced and propelled forwardly and away from electrostatic lens 11 with a large repulsive force (shown at area 91), a smaller force (shown at area 92), and a still smaller force (shown at area 93).

With needle electrodes 12 and 13 centered in apertures 9 and 10 of electrostatic focusing plate 11, the ions produced at the needle electrodes are focused by the electrostatic focusing plate to move forwardly and away from the needle electrodes toward the neutralizing area with the flow being in a substantially uniformly diverging cone pattern the axis of which is normal to the electrostatic focusing plate.

Halfway between the positive needle electrode and the negative needle electrode, a neutral zone 95 will be formed, as indicated in FIG. 3, where the lens will have zero charge. Of course, the positive and negative lens portions could be formed from two single pieces of material (rather than as a continuous plate as shown in FIG. 3).

As the positive and negative ions are propelled forwardly, positive ions will begin combining with negative ions in recombination zone 96. As brought out above, these charges of opposite polarity can coexist with neutral air molecules since there are about $3\times10^{19}$ neutral air molecules for every ion. However, some positive ions will also be neutralized by the negative ions.

As the cone of the negative ion zone, or area, 90 crosses over the cone of the positive ion zone, or area, 85, at a point forwardly of lens 11, the positive and negative ions become intermixed, as indicated in FIG. 3. The distance of intermixing is related to the physical shape and mechanical structure of the electrostatic lens system and can be set at any distance between the lens 11 and the maximum propulsion distance of the ions.

Figure 5:
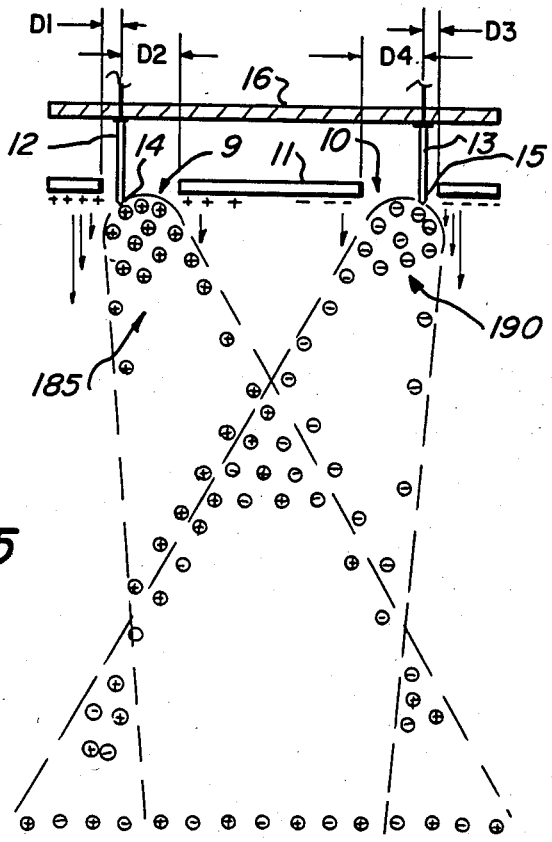
FIG. 5 is a partial top view similar to that of FIG. 3 and illustrating ion formation at the needle electrodes with the electrodes being offset with respect to the apertures in the electrostatic focusing plate to cause the ions to be directed outwardly in a pattern the axis of which forms an acute angle with respect to the electrostatic focusing plate.

As indicated in FIG. 5, the cone pattern of the positive and negative ion zones, or areas, 185 and 190 can be adjusted so that the axis of the cone pattern forms an acute angle with respect to the electrostatic focusing plate. As indicated in FIG. 5, when utilizing this arrangement, the positve and negative zones cross over one another. As also indicated in FIG. 5, this arrangement can be achieved by offsetting needle electrodes 12 and 13 within apertures 9 and 10 so that the needle electrodes are no longer centered within the apertures. As indicated in FIG. 5, by making distance D2 greater than distance D1, and by making distance D4 greater than distance D3, the cone patterns can be made to cross one another.

Offsetting the needle electrodes, with respect to the apertures, causes the field generated by the needle electrodes to create a larger positive charge at the side of the aperture nearer the positive needle electrode, and a larger negative charge at the said of the aperture nearer the negative needle electrode, thereby increasing the repulsion forces between these charges and the ionized air generated by needle electrodes 12 and 13. The dual electrostatic lens assembly 11 could be curved to form a concave or curved surface to accomplish the same results achieved by offsetting the needle electrodes with respect to the apertures.

As can be appreciated from the foregoing, this invention provides an improved electrostatic charge control device having an electrostatic focusing arrangement and requires no forced air unit to be utilized.

What is claimed is:

1. A static charge control device, comprising:

mounting means;

selectively chargeable electrostatic focusing means positioned forwardly of said mounting means with said electrostatic focusing means having a first opening formed by first wall means and a second opening formed by second wall means spaced form said first wall means, said first wall means being chargeable to a positive polarity and said second wall means being chargeable to a negative polarity;

first and second electrode means mounted on said mounting means with said first and second electrodes being spaced from one another a distance such that said first electrode extends through and beyond said first opening in said electrostatic focusing means and said second electrode extends through and beyond said second opening in said electrostatic focusing means; and voltage means for providing a positive voltage to said first electrode means and a negative voltage to said second electrode means so that positive ions are produced at said first electrode means and negative ions are produced at said second electrode means with said ions charging said first and second wall means of said focusing means adjacent to said electrode means to said positive and negative polarities, respectively, so that ions thereat are focused by said selectively chargeable electrostatic focusing means and separately directed away from each of said electrode means toward a neutralizing area for neutralizing of static charges thereat.

2. The device of claim 1 wherein said first and second electrode means are needle electrodes, and wherein said mounting means is a plate having said first and second needle electrodes mounted thereon with said needle electrodes extending outwardly from said plate so that the tip of each needle electrode extends beyond said electrostatic focusing means.

3. The device of claim 1 wherein said electrostatic focusing means is a plate, wherein said first and second spaced openings are circular apertures and wherein the free end of each of said electrode means extends through and beyond said circular apertures in said plate.

4. The device of claim 1 wherein said voltage means provides continuous DC voltages to said first and said second electrode means.

5. The device of claim 1 wherein said voltage means provides a positive voltage to said first electrode means that is greater than said negative voltage supplied to said second electrode means.

6. The device of claim 1 wherein said electrostatic focusing means directs ions away from said electrode means without use of forced air means.

7. The device of claim 1 wherein each of said electrode means is offset with respect to its associated opening in said electrostatic focusing means to thereby cause said ions produced at said electrodes to be forced outwardly and at an angle to converge with one another forwardly of said electrostatic focusing means.

8. A static charge control device, comprising:

a first plate;

a second plate positioned forwardly of said first plate and having first and second spaced openings therein;

first and second elongated electrodes mounted on said first plate and having the free end portion of each electrode extending into a different one of said first said second openings of said second plate; and voltage means for providing a continuous positive DC voltage to said first electrode and a continuous negative DC voltage to said second electrode whereby positive ions are produced at the free end portion of said first electrode and negative ions are produced at the free end portion of said second electrode with said ions charging said second plate adjacent to said electrodes so that ions thereat are focused by said second plate and electrostatically repulsed from said second plate toward a neutralizing area for neutralizing of static charges thereat.

9. The device of claim 8 wherein first and second plates are electrically non-conductive plates and are positioned substantially parallel to one another.

10. The device of claim 8 wherein said first and second electrodes have sharp tips which extend beyond the associated opening in said second plate receiving said electrode.

11. The device of claim 8 wherein said positive voltage provided to said first electrode is at least 1,000 volts greater than the negative voltage applied to said second electrode.

12. The device of claim 11 wherein said voltage means includes positive and negative voltage multiplier means both of which are connected to a common voltage source.

13. The device of claim 8 wherein said first and second electrodes are offset with respect to the associated opening in said second plate receiving said electrode for directing ions forwardly and angled toward one another so as to converge at said neutralizing area.

14. A static charge control device, comprising:

a housing having an electrically nonconductive wall at the front thereof, said wall having first and second apertures therein spaced with respect to one another, said housing otherwise defining a closed chamber;

an electrically non-conductive plate within said housing, said plate being positioned in the front portion of said housing and extending substantially parallel with the plane of said wall at the front of said housing;

first and second needle electrodes mounted on said plate in spaced relationship with respect to one another with each of said electrodes extending substantially normal to said first plate and having the tip of each said electrode extending forwardly through different ones of said first and second apertures in said wall of said housing; and voltage means providing a first continuous DC voltage of positive polarity to said first needle electrode and a second continuous DC voltage of negative polarity to said second needle electrode, with said positive voltage being greater in value than said negative voltage, and with said applied voltages causing positive ions to be produced at the tip of said first needle electrode and negative ions to be produced at the tip of said second needle electrode with said ions selectively charging said wall adjacent to said electrodes to thereby provide an electrostatic focusing arrangement so that ions thereat are focused and electrostatically repulsed from said wall toward a neutralizing area for neutralizing static charges thereat.

15. The device of claim 14 wherein said electrostatic focusing arrangement focuses said ions and directs said ions outwardly a sufficient distance such that said device need not include forced air means for moving air through said housing.

16. The device of claim 14 wherein said voltage means provides a positive voltage of about 6,000 volts to said first needle electrode and a negative voltage of about 5,000 volts to said second needle electrode.

17. The device of claim 16 wherein said voltage means includes oscillator means, a transformer, and positive and negative voltage multiplier means, said positive and negative voltage multiplier means being connected in common with said transformer means, with said positive voltage multiplier means being connected with said first needle electrode supplying said positive voltage thereto, and with said negative voltage multiplier means being connected with said second needle electrode to supply said negative voltage thereto.

18. The device of claim 14 wherein said first and second apertures in said wall are circular and wherein said needle electrodes are centrally positioned within an associated aperture to thereby cause said selective charging of said wall to be greater near said first and second apertures to direct ions thereat outwardly in a diverging pattern the axis of which is substantially normal to said wall and said plate.

19. The device of claim 14 wherein said first and second apertures in said wall are circular and wherein said needle electrodes are offset with respect to the center of an associated aperture to thereby focus ions away from said wall in a diverging pattern the axis of which forms an acute angle with respect to said wall and said plate.

* * * * *